US005977703A

United States Patent [19]

Ju et al.

[11] Patent Number: 5,977,703

[45] Date of Patent: Nov. 2, 1999

[54] FIELD EMISSION DISPLAY DEVICE

[75] Inventors: Byeong Kwon Ju, Kyungki-Do; Myung Hwan Oh, Seoul; Yun Hi Lee, Kyungki-Do, all of Rep. of Korea

[73] Assignee: Korea Institute of Science and Technology, Seoul, Rep. of Korea

[21] Appl. No.: 08/648,845

[22] Filed: May 15, 1996

[30] Foreign Application Priority Data

May 23, 1995 [KR] Rep. of Korea ..... 12870/1995

[51] Int. Cl.[6] ..... H01J 29/04

[52] U.S. Cl. ..... 313/495; 313/336; 313/309

[58] Field of Search ..... 313/309, 336, 313/351, 495, 496, 497

[56] References Cited

U.S. PATENT DOCUMENTS 5,442,255 8/1995 Ise et al. ..... 313/495
5,444,328 8/1995 Van Zutphen ..... 313/495

OTHER PUBLICATIONS

Huang et al., "Silicon Wafer Bonding for Sealed Vacuum Microelectronic Devices", *Eighth International Vacuum Microelectronics Conference*, pp. 159–163, (Jul. 30–Aug. 3, 1995, Portland, Oregon).

*Primary Examiner*—Nimeshkumar D. Patel
*Attorney, Agent, or Firm*—Townsend and Townsend and Crew LLP

[57] ABSTRACT

A field emission display device and a fabrication method thereof, by which a vacuum sealing can be simple, and electric and optical characteristics between pixels can be improved by achieving a device package by means of a junction between substrates in vacuum without a spacer, which includes a semiconductor substrate having a groove having a predetermined depth; an n-well formed on the semiconductor substrate under the bottom of the groove; an emitter formed on the n-well; an insulation film formed on a portion of the semiconductor substrate, in which the groove is not formed; a transparent electrode bonded to the upper portion of the insulation film; a light emitting layer arranged on the upper portion of the emitter and formed within the transparent electrode; and a glass substrate formed on the transparent electrode.

6 Claims, 3 Drawing Sheets

FIELD EMISSION DISPLAY DEVICE

1. FIELD OF THE INVENTION

The present invention relates to a field emission display device and a fabrication method thereof, and particularly to a improved field emission display device and a fabrication method thereof by which a fabrication cost can be reduced, and a reliability of device is enhanced by improving a fabrication process, and electric and optical characteristics.

2. DESCRIPTION OF THE CONVENTIONAL ART

Referring to FIG. 1A, a conventional field emission display (FED) device includes a triode vacuum tube having a negative electrode, a gate electrode, and a positive electrode.

That is, a negative electrode 2 is formed on a glass substrate or a semiconductor substrate 1, and an insulation film 3 on which a gate electrode 4 is formed and a triangle-shaped semiconductor(metal) tip 5 are alternately formed on the negative electrode 2. In addition, a transparent electrode 7 and a light emitting layer 8 through which light can pass are formed on a glass substrate 6, and a spacer 9 is formed between the substrates 1 and 6 so as to space out the substrates 1 and 6 at a predetermined interval.

Therefore, when a static voltage having a relatively high level is supplied to the gate electrode 4 formed on the insulation film 3, an electron is emitted from the top of the metal or semiconductor tip 5. The electron is condensed to a positive portion of a light emitting layer 8 through the glass substrate 6 and the transparent electrode 7 to which a static voltage having a relatively high level is supplied and through a process of an impact excitation with respect to the thusly emitted electron.

Meanwhile, recently a diode FED adapting a material having a low work function as an emitter such as a diamond thin film which is a kind of advanced devices was developed.

The above-mentioned diode type FED has the construction as shown in FIG. 1B. An emitter electrode 10 of a thin film type or a thick film type instead of a tip array is formed on the electrode 2, and it is formed with a negative electrode 2, a positive electrode 11, and a light emitting layer 12 formed on the positive electrode 11. That is, a gate electrode is not formed therein.

The diode type FED has advantages in that the construction and the fabrication process are simple, the manufacturing cost is low, the electric power consumption can be reduced, and upsizing of the product can be achieved. However, there are some unresolved problems in fabrication process and performance for practically using in the industry.

Since the above-mentioned devices need a vacuum sealing using a predetermined sealant during packaging, maintaining a ultra high vacuum (UHF) between the positive electrode and the negative electrode is necessary so as to prevent a collision between particles which occurs in operation of the device, an ionization, a vacuum breakdown, a physical and chemical particle suction, a back-ion bombardment and the like.

However, so as to prevent the above-mentioned problems, a material to be used for a spacer, a sealing technique, and a ultra high vacuum maintaining technique should be further developed.

SUMMARY OF THE INVENTION

Accordingly, it is an object of the present invention to provide a field emission display device and a fabrication method thereof, by which a vacuum sealing can be simple, and electric and optical characteristics between pixels can be improved by achieving a device package by means of a junction between substrates in vacuum without a spacer.

To achieve the above objects, there is provided a field emission display device, which includes a semiconductor substrate having a groove having a predetermined depth; an n-well formed on the semiconductor substrate under the bottom of the groove; an emitter formed on the n-well; an insulation film formed on a portion of the semiconductor substrate, in which the groove is not formed; a transparent electrode bonded to the upper portion of the insulation film; a light emitting layer arranged on the upper portion of the emitter and formed within the transparent electrode; and a glass substrate formed on the transparent electrode.

To achieve the above object, there is provided a field emission display device, which includes the steps of a first step which is directed to depositing an insulation film on a semiconductor substrate and selectively etching; a second step which is directed to etching the semiconductor substrate using aid insulation film as a mask by a predetermined depth, thus forming a groove so that a predetermined portion of the semiconductor substrate is exposed; a third step which is directed to forming an n-well under the bottom of the groove; a fourth step which is directed to forming an emitter at the n-well; and a fifth step which is directed to bonding a glass substrate, on which a transparent electrode and a light emitting layer are formed, to the semiconductor substrate, whereby a desired junction between two substrate can be achieved without an additional spacer.

BRIEF DESCRIPTION OF THE DRAWINGS

FIGS. 1A and 1B are cross-sectional views of a conventional field emission display device, of which:

FIG. 1A is a cross-sectional view of the construction of a triode type field emission display device; and FIG. 1B is a cross-sectional view of the construction of a diode type field emission display device;

FIGS. 2A and 2B are cross-sectional views of a field emission display device according to the present invention, of which:

FIG. 2A is a cross-sectional view of the construction of a diode type field emission display device adapting a tip array emitter according to the present invention; and FIG. 2B is a cross-sectional view of the construction of a diode type field emission display device adapting a thin film or a thick emitter according to the present invention;

FIGS. 3A and 3B are cross-sectional views of the construction of a diode type field emission display device adapting a stripe-shaped groove of a first embodiment according to the present invention, of which:

FIG. 3A is a plan view of the construction of a semiconductor substrate on which a field emission display device is formed according to the present invention; and FIG. 3B is a plan view of the construction of a glass substrate on which a light emitting layer is formed; and FIGS. 4A and 4B are plan views of the construction of a diode type field emission display device adapting a hollow-type groove of a second embodiment according to the present invention; of which:

FIG. 4A is a plan view of the construction of a semiconductor substrate on which a field emission display device is formed; and FIG. 4B is a plan view of the construction of glass substrate on which a light emitting layer is formed.

DETAILED DESCRIPTION OF THE INVENTION

Figure 1A:
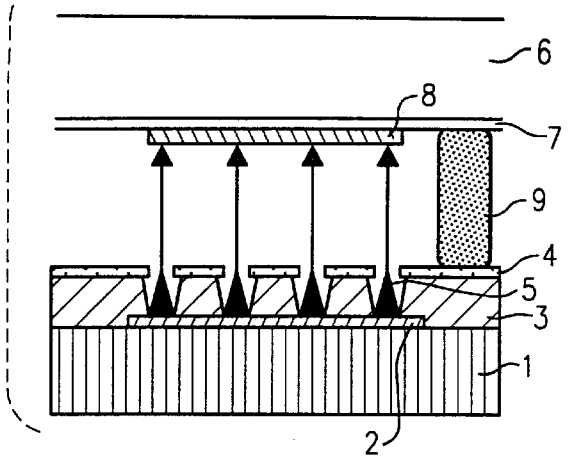
Figure 1B:
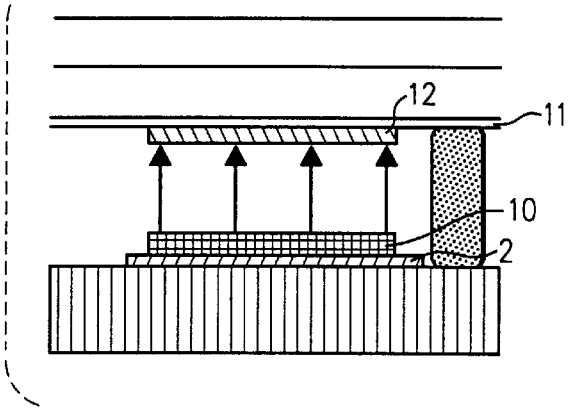
Figure 2A:
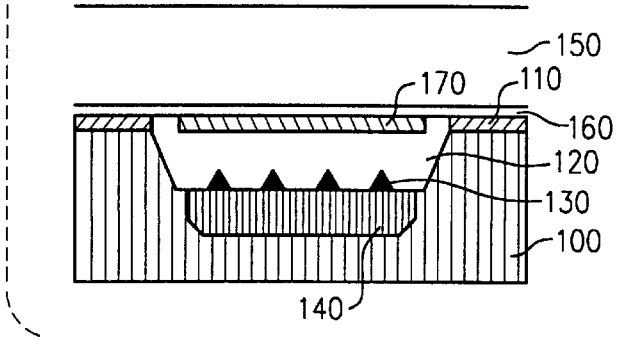
Figure 2B:
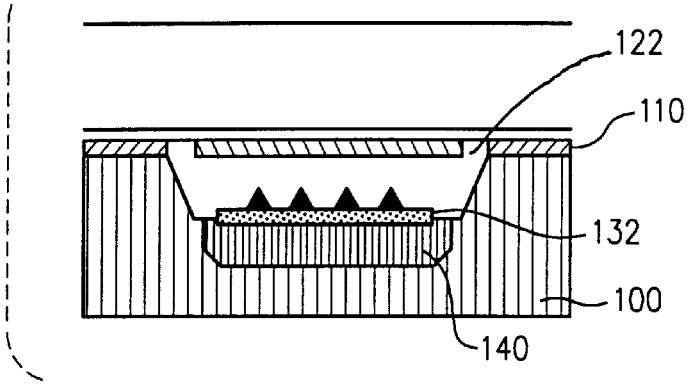

FIGS. 2A and 2B are cross-sectional views of a FED according to the present invention, of which FIG. 2A is a cross-sectional view of a diode type FED construction adapting a tip array emitter, and FIG. 2B is a cross-sectional view of a diode FED construction adapting a thin film or a thick emitter.

The basic construction of a FED according to the present invention will now be explained.

As shown therein, a P-type silicon substrate 100 (a negative substrate) having grooves 120 and 122 each having a predetermined depth and formed in an orientation dependent etching method using a silicon oxide pattern 110 as a mask is formed, and an n-well 140 is formed at the lower surface of the grooves through an injection and or a diffusion.

Emitters 130 and 132 which act as an electron generation source, are formed on the n-well. Here, the emitters 130 and 132 are formed with either an emitter which is shaped like a tip array 130 composed of a metal or a semiconductor as shown in FIG. 2A and an emitter which is shaped like a thick film 132 or all kinds of thin films including a diamond thin film as shown in FIG. 2B.

Figure 3A:
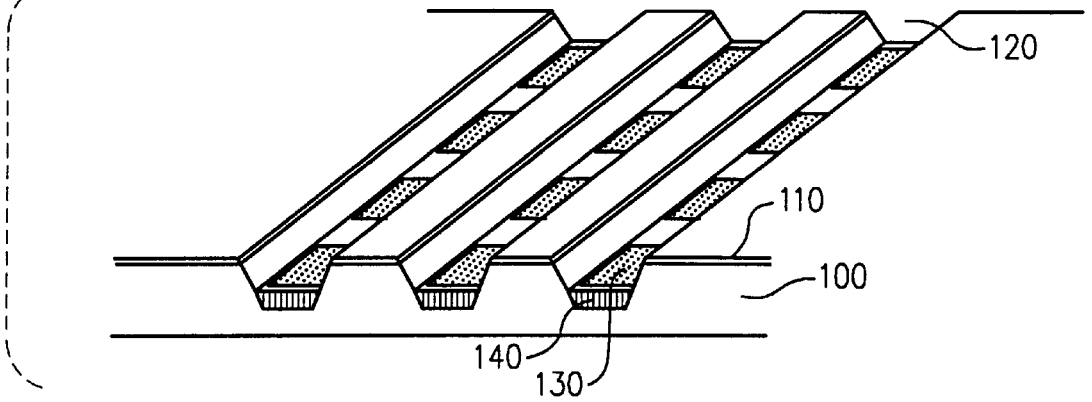
Figure 4A:
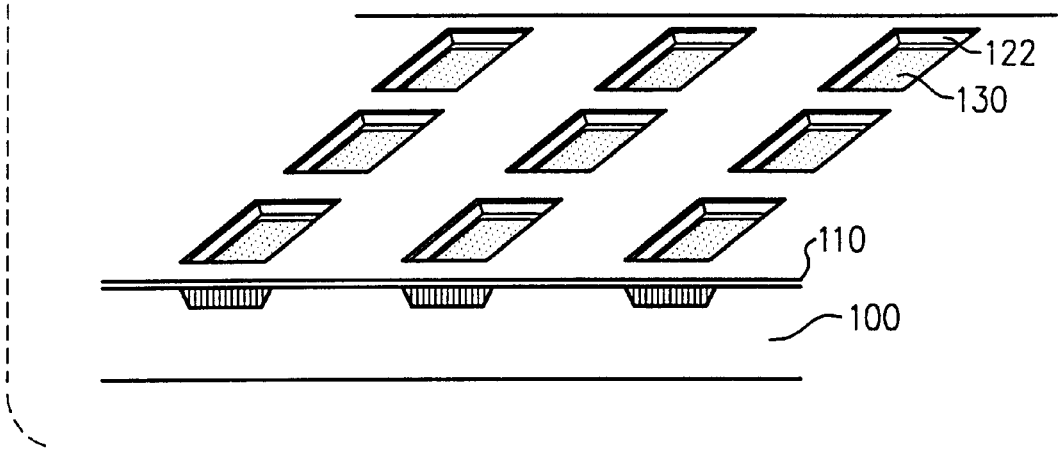

The reason that the emitters are formed in the n-well 140 of the grooves having a predetermined depth is to address an emitter of a thin or thick film type including a tip array. Here, the substrate 100, as shown in FIG. 3A, can be patterned to have a stripe-shaped groove 120, and can be patterned to have a cavity-shaped groove 122 as shown in FIG. 4A.

When assuming one groove as one pixel, the vertical cross-sectional view taken along line "a-a" of the pixel is shown in FIGS. 2A and 2B. That is, the pixel is shaped like a substrate except for the emitter to be formed in the groove. Here, the detailed etching process with respect to the substrate will be described later in this specification.

As positive and negative electrodes, a transparent electrode 160 made of an ITO material and a light emitting layer 170 are formed at a glass substrate 150 opposed to a P-type silicon substrate.

The positive and negative substrate (a glass substrate) 150 is bonded to a silicon substrate 100 (a negative substrate) in a static thermal junction, a junction method using a glass material which melts at a low temperature, a substrate junction at a low temperature, a polymer junction, and the like. The above-mentioned junction is performed by a contact between the transparent electrode 160 and the silicon oxide film 110.

That is, a packaging of a device is performed by a junction between two substrate in a vacuum without an additional spacer insertion process, and here the n-well 140 can be defined as an X-address line, and the transparent electrode 160 can be defined as a Y-address line, so that an X-Y addressing can be achieved.

Therefore, it is possible to adjust a distance between surfaces of the emitters 130 and 132 and the light emitting layer 170, which are an electron emitting surface, in accordance with a depth of the groove formed in the substrate, and here the maximum distance is about 1000 $\mu$m. Since the adjustable etching rate with respect to the silicon of the orientation dependent etchant is 1.0 $\mu$m/min., it is possible to adjust the distance between the positive/negative electrodes within a range of "$\Delta t$=0.1 $\mu$m".

As is the same as the depth of the groove, the surface area of the groove corresponding to the unit light emitting surface area at the time of completing a device fabrication and the distance between the grooves can be adjusted to the level of the sub-micron within an effective range of the conventional lithography. In addition, when defining one groove as one pixel, since the pixels are physically insulated from each other, it is possible to substantially prevent an electric and optical cross-talking phenomenon between pixels.

Next, the method of implementing first and second embodiments of a FED construction having the above-mentioned characteristics will be described with reference to the accompanying drawings.

Figure 3B:
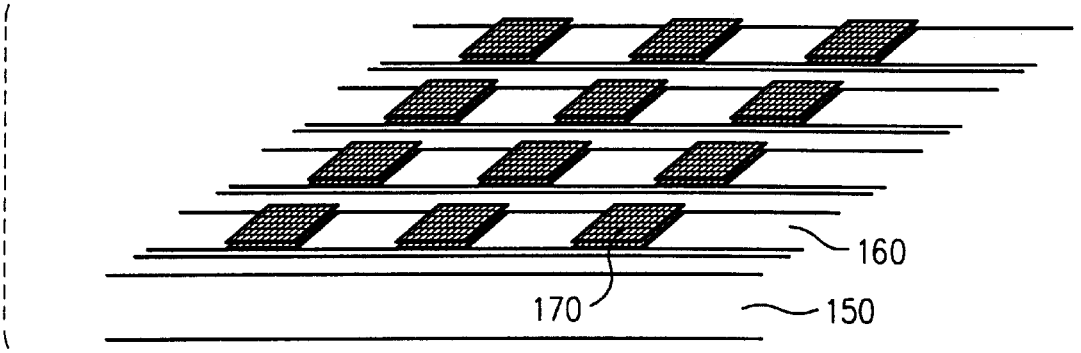

As a first embodiment, a diode type FED fabrication process using a stripe-shaped groove will now be described with reference to FIGS. 3A and 3B.

To begin with, a thermal oxide film 110 having (100) surface orientation is formed on the surface of a single crystal silicon substrate 100 to a thickness of 300 nm as an etching mask, and an oxide film is removed in a photolithography method and has a stripe shape in a vertical direction with respect to (110) surface of the substrate, thereby forming an oxide window.

Next, the silicon of which the oxide film is removed is removed by a depth of 5 $\mu$m by using an ethylene diamine-Pyrocatechol-Water solution which is an orientation dependent etchant, a KOH aqueous solution, a hydrazine aqueous solution, or the like.

At this time, the etching is not performed at a side portion 111; however, the etching is well performed in a vertical direction, thus forming a groove 120 having a desired dimension.

Thereafter, an n-well 140 is formed by doping in an ion-implantation method which is directed to ion-plantating impurities of V group elements such as P and As into the bottom portion of the groove 120 using the thermal oxide film 110, which is used as an etching mask, as a barrier, or in a diffusion method.

Thereafter, predetermined shaped emitters 130 and 132 having a predetermined surface area are formed at the bottom surface of the groove having an n-type conductivity. The emitters may be shaped like a silicon tip array which is formed in an wet etching method with respect to the silicon or may be formed by patterning after forming using a material such as a specific thin film such as a diamond film and the like or a thick film 132.

Next, the glass substrate 150 on which the patterned ITO transparent electrode 160 and the light emitting layer 170 are formed is bonded to the silicon substrate 100 in the above-described method after arranging the light emitting layer 170 and the emitters.

At this time, the bonding is performed under a UHV environment at the surface of the ITO transparent electrode 160 and the thermal oxide film 110 which is an etching mask, and both ends of the stripe are processed, and the device fabrication process is completed.

Meanwhile, in order to avoid a process with respect to the both ends of the stripe channel, a second embodiment may be performed.

Figure 4B:
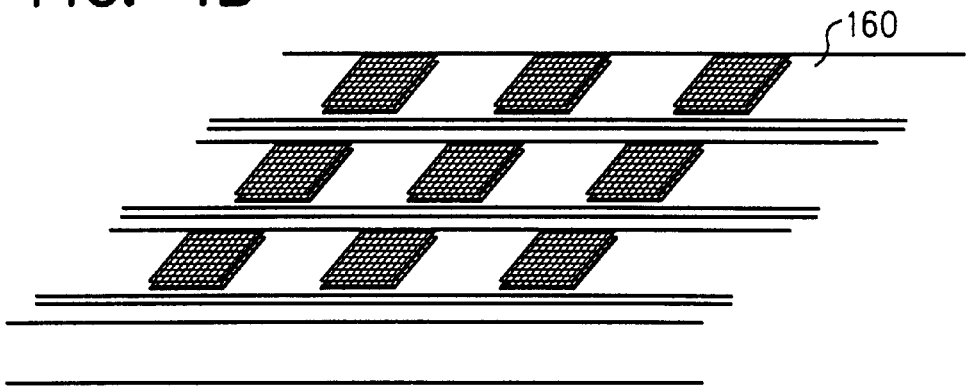

The second embodiment is directed to a diode type FED using a cavity-shaped groove as shown in FIGS. 4A and 4B. The fabrication process thereof is the same as the first embodiment except for the following processes.

When etching the thermal oxide film 110 formed on the single crystal silicon substrate 100 in a photolithography method, the thermal oxide film is removed so that a plurality of rectangular-shaped and spaced-apart patterns are exposed and formed on the surface of the silicon substrate 100, and grooves are formed within the silicon substrate 100 by orientation-dependent-etching the substrate using the thusly exposed portion as a mask.

That is, the silicon groove on which the emitters 130 and 132 are formed is shaped like a cavity. Here, one cavity corresponds to one pixel. Therefore, since each pixel is substantially isolated by the silicon construction, electric and optical cross-talks phenomenon that the emitted electrons excite the light emitting layer corresponding to neighboring pixels, and lights generated at the light emitting layer is transferred to neighboring pixels can be substantially prevented.

When two substrates are bonded, since the width of the transparent electrode formed on the glass substrate is wider than that of the cavity-shaped groove 122, the interior of the cavity automatically becomes a high vacuum when bonding the thermal oxide film 110 which is an etching mask and the transparent electrode 160 under a high vacuum environment, so that an additional vacuum sealing process is not necessary.

As described above, the field emission display device and a fabrication method thereof have advantages in that it is possible to adjust the distance between the positive and negative electrodes, the surface area of the pixel, the pitch, and the like in sub-micron dimension without an additional spacer. In addition, since the pixels are physically isolated, it is possible to prevent electric-optical cross-talks. Furthermore, since the two substrates are connected by bonding, the vacuum sealing is simple, and a FED having a desired physical durability and a high reliability can be fabricated.

Although the preferred embodiments of the present invention have been disclosed for illustrative purposes, those skilled in the art will appreciate that various modifications, additions and substitutions are possible, without departing from the scope and spirit of the invention as described in the accompanying claims.

What is claimed is:

1. A field emission display device, comprising:

a p-type semiconductor substrate having a groove having a predetermined depth;

an n-well formed on said semiconductor substrate under the bottom of said groove;

an emitter formed on said n-well;

an insulation film formed on a portion of the semiconductor substrate, in which the groove is not formed;

a patterned transparent electrode bonded to the upper portion of said insulation film;

a light emitting layer arranged on the upper portion of said emitter and formed within said patterned transparent electrode; and a glass substrate formed on the patterned transparent electrode.

2. The device of claim 1, wherein said semiconductor substrate includes a plurality of strip-shaped grooves which are continuously and alternately formed in the vertical direction with respect to a reference surface.

3. The device of claim 1, wherein said semiconductor substrate includes a plurality of spaced-part grooves, said grooves being rectangular and said grooves being cavity-shaped.

4. The device of claim 1, wherein said emitter is either a spaced-apart tip array or a silicon tip array.

5. The device of claim 1, wherein said emitter is a thin film shape or a thick film shape.

6. The device of claim 1, wherein said transparent electrode formed within said glass substrate has a width wider than that of the cavity-shaped groove formed within the semiconductor substrate.

* * * * *